US007236131B2

(12) United States Patent
Fager et al.

(10) Patent No.: US 7,236,131 B2
(45) Date of Patent: Jun. 26, 2007

(54) CROSS-POLARIZED ANTENNA

(76) Inventors: Matthew R. Fager, 17595 Mt. Herrmann, Fountain Valley, CA (US) 92708-4160; Ah Jee Wang, 17595 Mt. Hermmann, Fountain Valley, CA (US) 92708-4160

( * ) Notice: Subject to any disclaimer, the term of this patent is extended or adjusted under 35 U.S.C. 154(b) by 0 days.

(21) Appl. No.: 11/172,654

(22) Filed: Jun. 30, 2005

(65) Prior Publication Data

US 2007/0001908 A1 Jan. 4, 2007

Related U.S. Application Data

(60) Provisional application No. 60/695,788, filed on Jun. 29, 2005.

(51) Int. Cl.
*H01Q 1/38* (2006.01)

(52) U.S. Cl. ..... 343/700 MS; 343/797; 455/103

(58) Field of Classification Search ..... 343/700 MS, 343/702, 795, 797; 455/103, 456.4, 517
See application file for complete search history.

(56) References Cited

U.S. PATENT DOCUMENTS 6,351,247 B1 * 2/2002 Linstrom et al. ..... 343/797
6,567,056 B1 * 5/2003 Waltho ..... 343/797
6,782,266 B2 * 8/2004 Baer et al. ..... 455/456.4
6,823,177 B1 * 11/2004 Lucidarme ..... 455/103
6,847,328 B1 * 1/2005 Libonati et al. ..... 343/700 MS
2005/0157755 A1 * 7/2005 Kashkarov ..... 370/473

* cited by examiner

*Primary Examiner*—Tan Ho
(74) *Attorney, Agent, or Firm*—Berkeley Law & Technology Group

(57) ABSTRACT

Briefly, in accordance with one embodiment of the invention, an antenna may comprise a first radiating element to provide a first axis of polarization, and a second radiating element to provide a second axis of polarization. The first axis of polarization may be orthogonal or orthogonal at least in part, to the second axis of polarization. The first and second axes together may result in an omnidirectional, or at least partially omnidirectional, gain pattern for the antenna. RF signals may be propagated on the first and second axes using the same communication standard on both axes, and/or using a different communication standard on each of the axes. In accordance with one or more embodiments, the first axis of polarization may be utilized for a first MIMO communication channel, and the second axis of polarization may be utilized for a second MIMO communication channel.

28 Claims, 4 Drawing Sheets

CROSS-POLARIZED ANTENNA

CROSS-REFERENCE TO RELATED APPLICATIONS

The present application claims the benefit of U.S. Provisional Application No. 60/695,788, Express Mail Label No. 006469993 US filed Jun. 29, 2005.

BACKGROUND

Wireless connectivity of between devices on electronic networks has become increasingly implemented with electronic devices such as personal computers, laptop computers, personal digital assistants, electronic mail devices, and so on. Typically, such wireless connectivity is implemented using one or more wireless local area network (WLAN) communication standards promulgated by the Institute of Electrical and Electronics Engineers (IEEE), including, for example, IEEE Standard 802.11a, IEEE Standard 802.11b, IEEE 802.11g, IEEE 802.11n, and so on. Smart antenna systems may be utilized with such a wireless local area network and/or a wireless wide area network such as a cellular telephone system in which devices that have multiple antennas may increase the performance of such networks including, for example, reducing fading due to multipath reflections, and increasing link quality, throughput, and range.

DESCRIPTION OF THE DRAWING FIGURES

Claimed subject matter is particularly pointed out and distinctly claimed in the concluding portion of the specification. However, both as to organization and/or method of operation, together with objects, features, and/or advantages thereof, may best be understood by reference to the following detailed description when read with the accompanying drawings in which:

Figure 1:
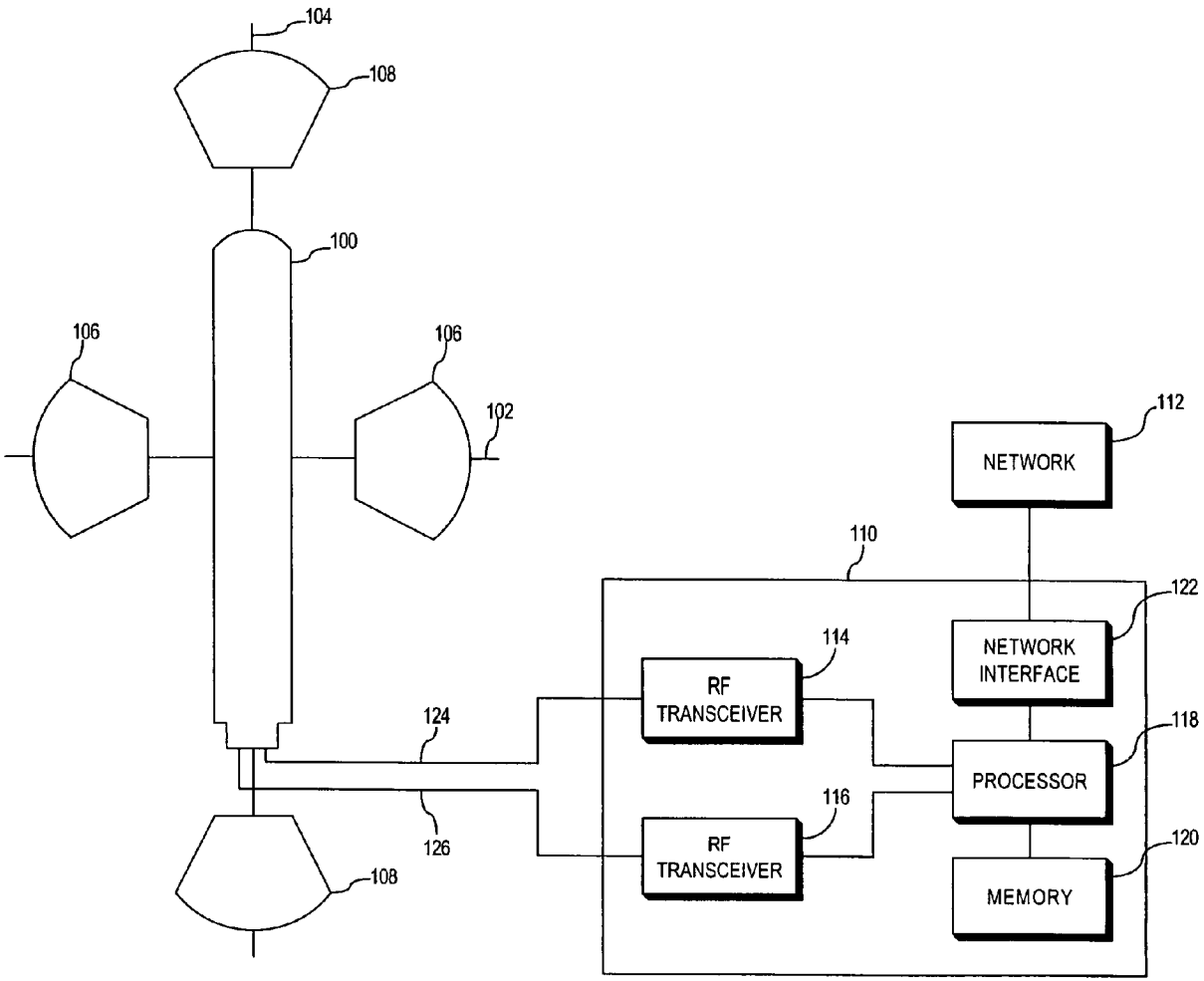
FIG. 1 is a diagram of a cross-polarized antenna coupled to a wireless router type device in accordance with one or more embodiments.

It will be appreciated that for simplicity and/or clarity of illustration, elements illustrated in the figures have not necessarily been drawn to scale. For example, the dimensions of some of the elements may be exaggerated relative to other elements for clarity. Further, if considered appropriate, reference numerals have been repeated among the figures to indicate corresponding or analogous elements.

DETAILED DESCRIPTION

In the following detailed description, numerous specific details are set forth to provide a thorough understanding of claimed subject matter. However, it will be understood by those skilled in the art that claimed subject matter may be practiced without these specific details. In other instances, well-known methods, procedures, components and/or circuits have not been described in detail.

Embodiments claimed may include apparatuses for performing the operations herein. This apparatus may be specially constructed for the desired purposes, or it may comprise a general purpose computing device selectively activated and/or reconfigured by a program stored in the device. Such a program may be stored on a storage medium, such as, but is not limited to, any type of disk including floppy disks, optical disks, CD-ROMs, magnetic-optical disks, read-only memories (ROMs), random access memories (RAMs), electrically programmable read-only memories (EPROMs), electrically erasable and/or programmable read only memories (EEPROMs), flash memory, magnetic and/or optical cards, and/or any other type of media suitable for storing electronic instructions, and/or capable of being coupled to a system bus for a computing device and/or other information handling system.

In the following description and/or claims, the terms coupled and/or connected, along with their derivatives, may be used. In particular embodiments, connected may be used to indicate that two or more elements are in direct physical and/or electrical contact with each other. Coupled may mean that two or more elements are in direct physical and/or electrical contact. However, coupled may also mean that two or more elements may not be in direct contact with each other, but yet may still cooperate and/or interact with each other. In one or more embodiments, multiple-input, multiple-output (MIMO) may refer to a communication technique in which information may be transmitted and/or received using two or more signal paths, for example using two or more radio-frequency signal paths, wherein multipath signals may be utilized to increase information throughput, and a MIMO transceiver may refer to a transceiver to transmit and/or receive MIMO type communication signals, although the scope of the claimed subject matter is not limited in this respect. In particular embodiments, MIMO type communications may employ orthogonal frequency-division multiplexing (OFDM) techniques, although the scope of the claimed subject matter is not limited in this respect. In one or more embodiments, diversity in radio-frequency communications may refer to a scheme in which a transceiver may communicate using two or more communication paths, and the signal path exhibiting a stronger signal strength may be selected for communication at a given moment in time. A diversity transceiver in one or more embodiments may employ two or more antennas and select to communicate by utilizing the antenna with a stronger signal strength than the other antenna or antennas, although the scope of the claimed subject matter is not limited in this respect. In one or more embodiments, element may refer to a constituent of a composite entity. In particular embodiments, an antenna element may refer to a constituent antenna of a composite antenna and/or a constituent antenna of a group of antennas, and a radiating element of an antenna may refer to a constituent radiator of an antenna in a composite radiator and/or a constituent radiator of an antenna of a group of radiators of an antenna and/or group of antennas, although the scope of the claimed subject matter is not limited in this respect.

It should be understood that certain embodiments may be used in a variety of applications. Although the claimed subject matter is not limited in this respect, the circuits disclosed herein may be used in many apparatuses such as in the transmitters and/or receivers of a radio system. Radio systems intended to be included within the scope of the claimed subject matter may include, by way of example, wireless personal area networks (WPAN) such as a network in compliance with the WiMedia Alliance, a wireless local area networks (WLAN) devices and/or wireless wide area network (WWAN) devices including wireless network interface devices and/or network interface cards (NICs), base stations, access points (APs), gateways, bridges, hubs, cellular radiotelephone communication systems, satellite communication systems, two-way radio communication systems, one-way pagers, two-way pagers, personal communication systems (PCS), personal computers (PCs), personal digital assistants (PDAs), and/or the like, although the scope of the claimed subject matter is not limited in this respect.

Types of wireless communication systems intended to be within the scope of the claimed subject matter may include, although are not limited to, Wireless Local Area Network (WLAN), Wireless Wide Area Network (WWAN), Code Division Multiple Access (CDMA) cellular radiotelephone communication systems, Global System for Mobile Communications (GSM) cellular radiotelephone systems, North American Digital Cellular (NADC) cellular radiotelephone systems, Time Division Multiple Access (TDMA) systems, Extended-TDMA (E-TDMA) cellular radiotelephone systems, third generation (3G) systems like Wideband CDMA (WCDMA), CDMA-2000, and/or the like, although the scope of the claimed subject matter is not limited in this respect.

Figure 2:
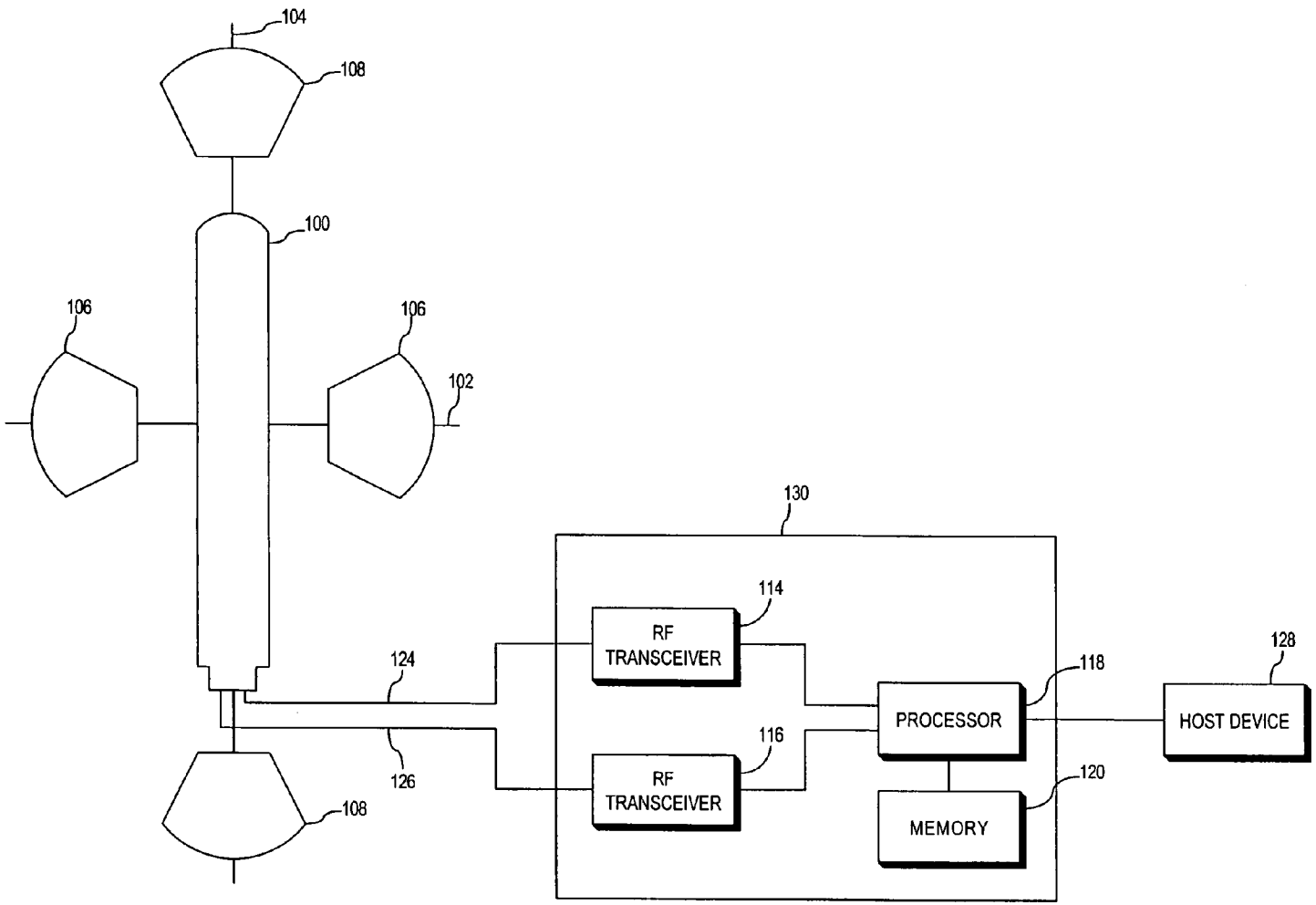
FIG. 2 is a diagram of a cross-polarized antenna coupled to a remote device in accordance with one or more embodiments.

Referring now to FIG. 1, a diagram of a cross-polarized antenna coupled to a wireless router type device in accordance with one or more embodiments will be discussed. As shown in FIG. 1, antenna 100 may couple to router 110 which may be, for example, any type of access point, router, gateway, switch, and/or hub to connect one or more devices to network 112. At a least a portion of the functionality of router 110 may be to allow a remote device, for example as shown in FIG. 2, to couple to network 112 via router 110, for example by forwarding data packets between the remote device and network 112, although the scope of the claimed subject matter is not limited in this respect. Antenna 100 may be cross-polarized in that it may radiate signals on first axis 102 and/or on second axis 104 where first axis 102 may be orthogonal to, or nearly orthogonal to, second axis 104. For example, a first signal applied to first axis 102 may result in first gain pattern 106, and a second signal applied to second axis 104 may result in second gain pattern 108. In one embodiment, when a first signal is applied to first axis 102, antenna 100 generally may exhibit higher gain along first axis 102 and lower gain along second axis 104 responsive to the first signal. Likewise, when a second signal is applied to second axis 104, antenna 100 generally may exhibit higher gain along second axis 104 and lower gain along first axis 102. In one particular embodiment, when the same signal is applied to both first axis 102 and second axis 104 simultaneously, antenna 100 may provide a more omnidirectional type gain characteristic since the nulls in the radiation pattern of one axis may be filled by the peaks in the radiation pattern of the other axis, and vice-versa. In general, an omnidirectional antenna may be defined as an antenna that that may exhibit equal field strength, or nearly equal field strength, along one or more axes and/or along one or more planes of the antenna, although the scope of the claimed subject matter is not limited in this respect.

As shown in FIG. 1, antenna 100 may couple with router 110 to provide antenna functionality to router 110, for example where router is a wireless type router. Antenna 100 may include first lead 124 and second lead 126 to couple to radio-frequency (RF) transceiver 114 and/or to radio-frequency (RF) transceiver 116. RF transceiver 114 and/or RF transceiver 116 may couple to processor 118, which in one or more embodiments may operate as a baseband processor to process baseband signals, for example. Processor 118 may couple to memory 120 that may store one or more instructions and/or programs, and/or data, that may be utilized by processor 118. Processor 118 may couple to a network interface 122 to couple router 110 to network 112. In one embodiment, network 112 may include the internet or similar type of distributed network, and/or alternatively network 112 may be any type of various network such as a local area network (LAN), wide area network (WAN), metropolitan area network (MAN), and/or the like. In one or more embodiments, network 112 may comprise at least in part a wired network, and/or at least in part a wireless network. In one or more embodiments, network 112 may comprise a cellular telephone network, and/or a public switched telephone network (PSTN). However, these are merely examples of networks, and the scope of the claimed subject matter is not limited in these respects.

In one or more embodiments, router 110 may be capable of utilizing antenna 100 to communicate using one or more wireless transmission standards. For example, at least one or RF transceiver 114 and/or wireless transceiver 116 of router 110 may be arranged to communicate using a wireless local area network transmission standard, such as in accordance with an IEEE 802.11a standard, an IEEE 802.11b standard, an IEEE 802.11g standard, and/or an IEEE 802.11n standard. In one embodiment, router 110 may transmit and/or receive signals via antenna 100 in accordance with one such standard by transmitting and/or receiving simultaneously on both of first axis 102 and second axis 104, for example to provide an omnidirectional radiation pattern, or at least a nearly omnidirectional radiation pattern for signals transmitted and/or received using such a standard. In another embodiment, router 110 may transmit and/or receive signals with antenna 100 by utilizing RF transceiver 114 to communicate using a first communication standard, for example IEEE Standard 802.11a, to transmit and/or receive along first axis 102, and may transmit and/or receive signals with antenna 100 by utilizing RF transceiver 116 to communicate using a second communication standard, for example IEEE Standard 802.11g, where such communication using two standards may occur simultaneously. For example where router 110 may communicate with a first remote device using IEEE Standard 802.11a and may communicate with a second remote device using IEEE Standard 802.11g, although the scope of the claimed subject matter is not limited in this respect.

In one or more embodiments, router 110 may operate using multiple-input, multiple output (MIMO) type communication. In one particular embodiment, router may operate in accordance with an IEEE 802.11n standard. In a MIMO type embodiment, router 110 may utilize one of antenna 100 for MIMO type and/or smart antenna type communication, for example where RF transceiver 114 and RF transceiver 116 are arranged to operate in a MIMO type mode. In one particular embodiment, router 110 may be a D-Link Super G® with MIMO Wireless Router available from D-Link Systems, Inc. of Fountain Valley, Calif., USA, although the scope of the claimed subject matter is not limited in this respect. In one such embodiment, router 110 may utilize one of antenna 100 to implement MIMO type communications using two MIMO communication channels with antenna 100, for example where a first MIMO communication channel may be utilized on first axis 102 and a second MIMO communication channel may be utilized on second axis 104. In another embodiment, router 110 may utilize additional MIMO channels with two or more antennas, at least some of which may be cross-polarized antennas such as antenna 100. In embodiments where multiple antennas such as antenna 100 are utilized, two MIMO channels may be utilized on for each corresponding one of antenna 100, although the scope of the claimed subject matter is not limited in this respect. In an alternative embodiment, router 110 may implement a spatial division multiple access (SDMA) system, smart antenna system, and/or a multiple input, multiple output (MIMO) system, although the scope of the claimed subject matter is not limited in this respect. Router 110 may couple with network 112 so that a remote device may communicate with network 112, including devices coupled to network 112, by communicating with router 110 via a wireless communication link and antenna 100. Network 112 may include a public network such as a telephone network and/or the internet, and/or alternatively network 112 may include a private network such as an intranet, and/or a combination of a public and/or a private network, although the scope of the claimed subject matter is not limited in this respect.

Processor 118 may operate to provide baseband and/or media access control (MAC) processing functions. Processor 118 may comprise a single processor, and/or alternatively may comprise a baseband processor and/or an applications processor, although the scope of the claimed subject matter is not limited in this respect. Processor 118 may couple to memory 120 which may comprise volatile memory such as DRAM, non-volatile memory such as flash memory, and/or alternatively may include other types of storage such as a hard disk drive, although the scope of the claimed subject matter is not limited in this respect. Some portion or all of memory 120 may be included on the same integrated circuit as processor 118, and/or alternatively some portion and/or all of memory 120 may be disposed on an integrated circuit and/or other medium, for example a hard disk drive, that is external to the integrated circuit of processor 118, although the scope of the claimed subject matter is not limited in this respect.

Communication between router 110 a remote device may be implemented via a wireless personal area networks (WPAN) such as in compliance with the WiMedia Alliance, a wireless local area network (WLAN), for example a network compliant with a an Institute of Electrical and Electronics Engineers (IEEE) standard such as IEEE 802.11a, IEEE 802.11b, IEEE 802.11g, IEEE 802.11n, IEEE 802.16, HiperLAN-II, HiperMAN, Ultra-Wideband (UWB), and so on, although the scope of the claimed subject matter is not limited in this respect. In another embodiment, communication between router 110 and a remote device may be at least partially implemented via a cellular communication network compliant with a Third Generation Partnership Project (3GPP or 3G) standard, a Wideband CDMA (WCDMA) standard, and/or other types of cellular networks, although the scope of the claimed subject matter is not limited in this respect.

Referring now to FIG. 2, a diagram of a cross-polarized antenna coupled to a remote device in accordance with one or more embodiments will be discussed. Remote device 130 is substantially similar to router 110 of FIG. 1 with at least one or more of the following differences. Remote device 130 may be, for example, a radio adapter for a portable device such as a laptop computer, personal digital assistant, cellular telephone, and/or the like. In one embodiment, remote device 130 may be a D-Link Super G® with MIMO Wireless Notebook Adapter or similar type device such as a PC Card type adapter, although the scope of the claimed subject matter is not limited in this respect. Remote device 130, in one or more embodiments, may couple to a host device 128, which may be, for example, a laptop computer, personal digital assistant, cellular telephone, and/or the like type of device in which remote device may be utilized, although the scope of the claimed subject matter is not limited in this respect.

Figure 3:
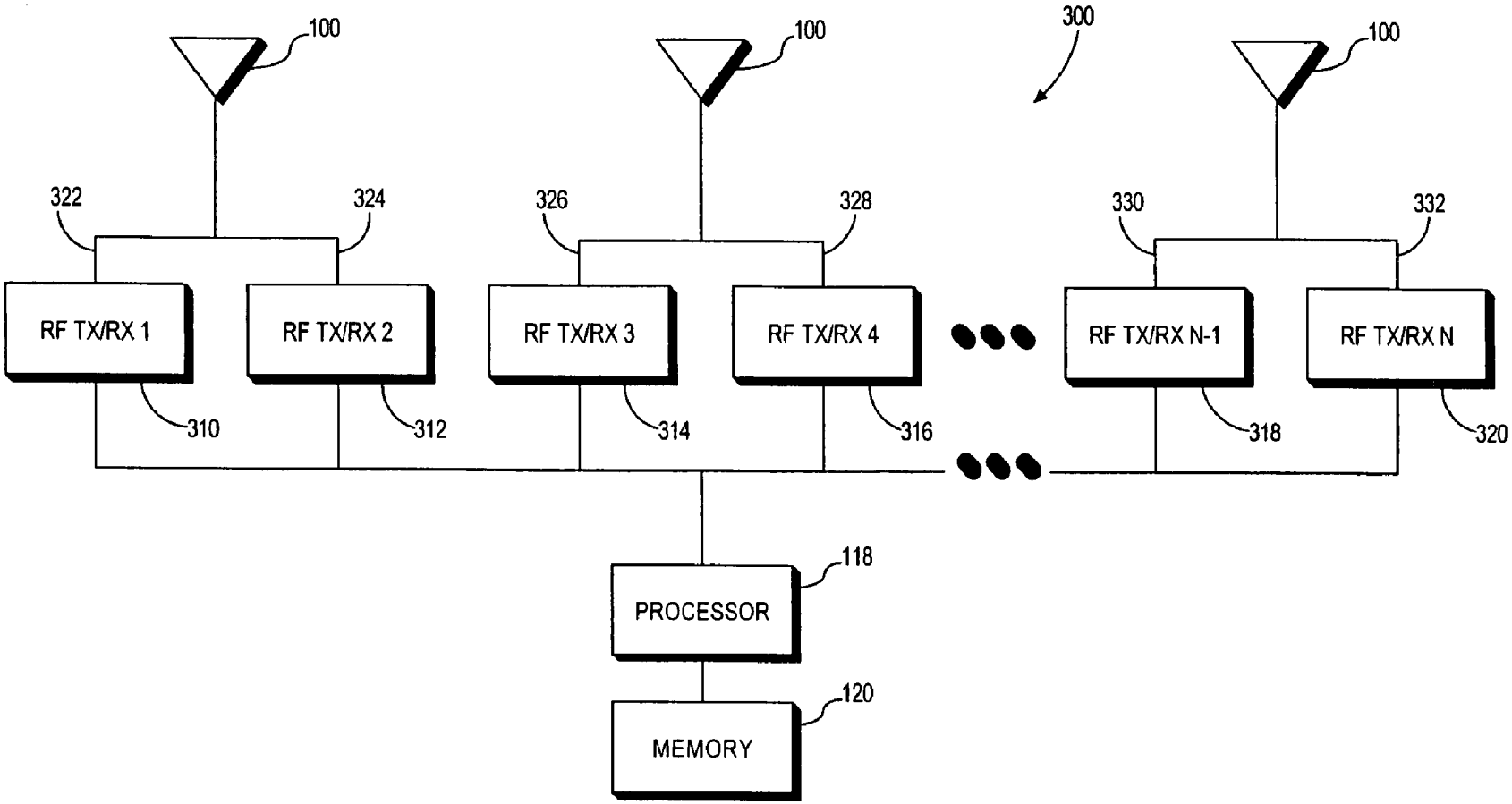
FIG. 3 is a diagram of a smart antenna type device including two or more cross-polarized antennas in accordance with one or more embodiments.

Referring now to FIG. 3, a diagram of a smart antenna type device including two or more cross-polarized antennas in accordance with one or more embodiments in accordance with one or more embodiments will be discussed. As shown in FIG. 3, device 300 may include two or more of antenna 100. Device 300 may be, for example, a router type device such as router 110 of FIG. 1 or may be a remote device such as remote device 130 of FIG. 2. In the embodiment shown in FIG. 3, one antenna 100 may couple to RF transceivers 310 and 312, another antenna 100 may couple to RF transceivers 314 and 316, and so on, up to another antenna 100 that may couple to an N-1$^{th}$ RF transceiver 318 and to an N$^{th}$ RF transceiver 320. In one or more embodiments, where there are N number of RF transceivers, device 300 may utilize N/2 antennas in the case where each of antennas 100 couples with two corresponding RF transceivers. In other embodiments, at least some of the antennas may be single feed type antennas, and some of the antennas may be dual feed, cross-polarized antennas such as antenna 100, in which case the number of antennas utilized by device 300 may range from N/2 to N. In one or more embodiments, device 300 may be arranged to provide MIMO type operation, spatial division, multiple access (SDMA) type operation, and or smart antenna type operation. However, these are merely examples of how device may utilize two or more of antennas 100, and the scope of the claimed subject matter is not limited in this respect.

Figure 4:
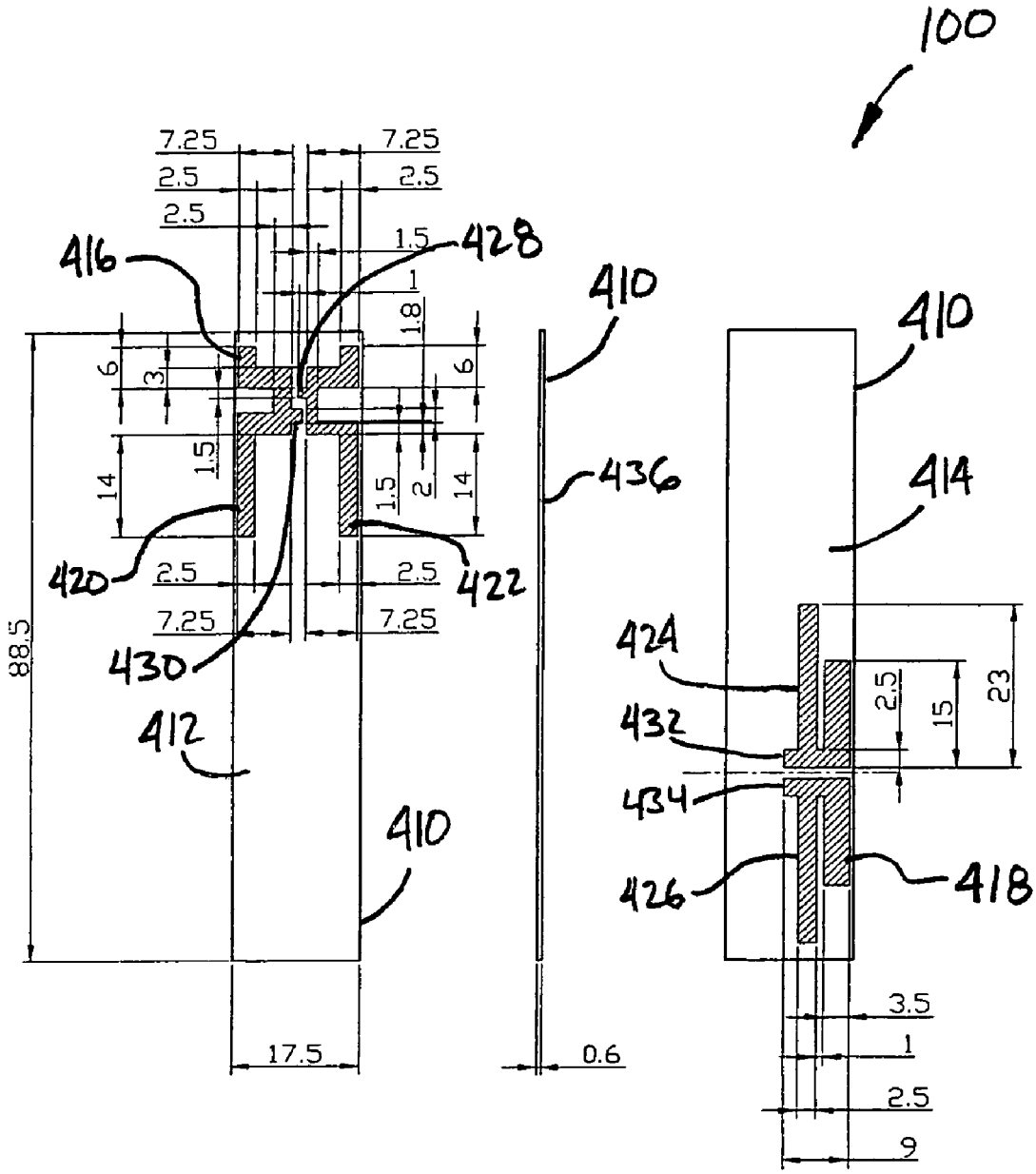
FIG. 4 is a diagram showing the structural details of a cross-polarized antenna in accordance with one or more embodiments.

Referring now to FIG. 4, a diagram of a cross-polarized antenna showing structural details of the antenna in accordance with one or more embodiments will be discussed. As shown in FIG. 4, antenna 100 may comprise a circuit board 410 having first side 412 and second side 414. Antenna element 416 may be disposed on first side 412 of circuit board, and antenna element 418 may be disposed on second side of circuit board, although the scope of the claimed subject matter is not limited in this respect. In an alternative embodiment, antenna element 416 and antenna element 418 may be disposed on the same side of circuit board 410, such as one of first side 412 and/or one of second side 414, although the scope of the claimed subject matter is not limited in this respect.

In one embodiment, first antenna element 416 may correspond to second axis 104 and second gain pattern 108 as shown in FIG. 1, and likewise second antenna element 418 may correspond to first axis 102 and first gain pattern 106 as shown in FIG. 1, although the scope of the claimed subject matter is not limited in this respect. In one embodiment, dimensions shown in FIG. 4 may refer to millimeters, however dimensions shown in FIG. 4 alternatively may not be to scale, and the scope of claimed subject matter is not limited in this respect. Antenna element 416 may comprise radiating element 420 and radiating element 422. First lead 124 as shown in FIG. 1 may couple to contact point 428 of radiating element 422 and to contact point 420 of radiating element 420. Likewise, antenna element 418 may comprise radiating element 424 and radiating element 426. Second lead 126 as shown in FIG. 1 may couple to contact point 432 of radiating element 424 and to contact point 434 of radiating element 426. An edge view of circuit board 410 is shown at 436. Although a particular arrangement of circuit board 410, antenna elements 416 and 418, radiating elements 420, 422, 424, and 426, and contact points 428, 430, 432, and 434 is depicted in FIG. 1, these are merely examples arrangements of such antenna elements, radiating elements, and contact points of antenna 100, and other arrangements are within the scope of the claimed subject matter. By commonly disposing antenna element 416 and antenna element 418 on circuit board 410, and arranging first axis of polarization 102 and gain pattern 106 with respect to second axis of polarization 104 and second gain pattern 108, for example orthogonally arranged, an omnidirectional overall gain pattern, and/or a nearly omnidirectional gain pattern, may be achieved. Furthermore, two or more RF signals may be applied to antenna 100 with a lesser amount of co-interference between the two or more RF signals. Circuit board 410 with antenna elements 416 and 418 may be disposed within a single antenna housing (not shown), for example to reduce the overall number of antenna housing for router 110 and/or remote device 130. In one such embodiment, a device having two MIMO channels may utilize single antenna housing, a device having four MIMO channels may utilize two antenna housings, and so on, although the scope of the claimed subject matter is not limited in this respect. Furthermore, for example, a single antenna housing for a device such as router 110 and/or remote device 130 may be utilized in applications where two antenna housing are otherwise utilized, for example to provide an omnidirectional like gain pattern using two antenna housings that are movable with respect to one another, and/or in a diversity arrangement to reduce fading effects, and so on, although the scope of the claimed subject matter is not limited in this respect.

Although the claimed subject matter has been described with a certain degree of particularity, it should be recognized that elements thereof may be altered by persons skilled in the art without departing from the spirit and/or scope of the claimed subject matter. It is believed that the cross-polarized antenna and/or many of its attendant advantages will be understood by the forgoing description, and it will be apparent that various changes may be made in the form, construction and/or arrangement of the components thereof without departing from the scope and/or spirit of the claimed subject matter or without sacrificing all of its material advantages, the form herein before described being merely an explanatory embodiment thereof, and/or further without providing substantial change thereto. It is the intention of the claims to encompass and/or include such changes.

What is claimed is:

1. An apparatus, comprising:

a first RF transceiver and a second RF transceiver;

a processor to couple to said first RF transceiver and to said second RF transceiver;

an antenna, said antenna having a first axis of polarization for communication using said first RF transceiver, and a second axis of polarization for communication using said second RF transceiver, wherein said first axis of polarization is orthogonal at least in part to said second axis of polarization;

a third RF transceiver and a fourth RF transceiver; and an additional antenna, said additional antenna having a third axis of polarization for communication using said third RF transceiver, and a fourth axis of polarization for communication using said fourth RF transceiver, wherein said third axis of polarization is orthogonal at least in part to said fourth axis of polarization.

2. The apparatus of claim 1, said first axis corresponding to a first radiating element of said antenna, and said second axis corresponding to a second radiating element of said antenna, said first radiating element and said second radiating element being disposed in a common housing.

3. An apparatus as claimed in claim 1, further comprising a network interface to couple said processor to a network, said processor to transfer data between a remote device and the network.

4. An apparatus as claimed in claim 1, said processor to couple to a host device to transfer data between a remote device and the host device.

5. An apparatus as claimed in claim 1, said first RF transceiver to communicate with a first remote device via said first axis of polarization of said antenna, and said second RF transceiver to communicate with a second remote device via said second axis of polarization of said antenna.

6. An apparatus as claimed in claim 1, said first RF transceiver to communicate via a first MIMO channel on said first axis of polarization of said antenna, and said second RF transceiver to communicate via a second MIMO channel on said second axis of polarization of said antenna.

7. An apparatus as claimed in claim 1, said first RF transceiver and said second RF transceiver to provide beam steering via said first axis of polarization of said antenna and said second axis of polarization of said antenna.

8. An apparatus as claimed in claim 1, said first RF transceiver to communicate with a first remote device using a first communication standard via said first axis of polarization of said antenna, and said second RF transceiver to communicate with a second remote device using a second communication standard via said second axis of polarization of said antenna.

9. An apparatus as claimed in claim 1, wherein said first RF transceiver is adapted to communicate via a first MIMO channel on said first axis of polarization of said antenna, said second RF transceiver is adapted to communicate via a second MIMO channel on said second axis of polarization of said antenna, said third RF transceiver is adapted to communicate via a third MIMO channel on said third axis of polarization of said additional antenna, and said fourth RF transceiver is adapted to communicate via a fourth MIMO channel on said fourth axis of polarization of said additional antenna.

10. An apparatus as claimed in claim 1, wherein said first means for transmitting and/or receiving RF signals is adapted to communicate via a first MIMO channel on said first axis of polarization of said means for transmitting and/or receiving electromagnetic energy, said second means for transmitting and/or receiving RF signals adapted to communicate via a second MIMO channel on said second axis of polarization of said means for transmitting and/or receiving electromagnetic energy, said third means for transmitting and/or receiving RF signals adapted to communicate via a third MIMO channel on said third axis of polarization of said additional means for transmitting and/or receiving electromagnetic energy, and said fourth means for transmitting and/or receiving RF signals adapted to communicate via a fourth MIMO channel on said fourth axis of polarization of said additional means for transmitting and/or receiving electromagnetic energy.

11. An apparatus, comprising:

first means for transmitting and/or receiving RF signals, and a second means for transmitting and/or receiving RF signals;

means for processing electronic signals to couple to said first means for transmitting and/or receiving RF signals and to said second means for transmitting and/or receiving RF signals; and means for transmitting and/or receiving electromagnetic energy, said means for transmitting and/or receiving electromagnetic energy having a first axis of polarization for communication using said first means for transmitting and/or receiving RF signals, and a second axis of polarization for communication using said second means for transmitting and/or receiving RF signals, wherein said first axis of polarization is orthogonal at least in part to said second axis of polarization;

a third means for transmitting and/or receiving RF signals and a fourth means for transmitting and/or receiving RF signals; and an additional means for transmitting and/or receiving electromagnetic energy, said additional means for transmitting and/or receiving electromagnetic energy having a third axis of polarization for communication using said third means for transmitting and/or receiving RF signals, and a fourth axis of polarization for communication using said fourth means for transmitting and/or receiving RF signals, wherein said third axis of polarization is orthogonal at least in part to said fourth axis of polarization.

12. An apparatus a claimed in claim 11, said first axis corresponding to a first radiating element of said means for transmitting and/or receiving electromagnetic energy, and said second axis corresponding to a second radiating element of said means for transmitting and/or receiving electromagnetic energy, said first radiating element and said second radiating element being disposed in a common housing.

13. An apparatus as claimed in claim 11, further comprising a network interface to couple said means for processing to a network, said process to transfer data between a remote device and the network.

14. An apparatus as claimed in claim 11, wherein said means for processing is coupled to a host device to transfer data between a remote device and the host device.

15. An apparatus as claimed in claim 11, said first means for transmitting and/or receiving RF signals to communicate with a first remote device via said first axis of polarization of said means for transmitting and/or receiving electromagnetic energy, and said second means for transmitting and/or receiving RF signals to communicate with a second remote device via said second axis of polarization of said means for transmitting and/or receiving electromagnetic energy.

16. An apparatus as claimed in claim 11, said first means for transmitting and/or receiving RF signals to communicate via a first MIMO channel on said first axis of polarization of said means for transmitting and/or receiving electromagnetic energy, and said second means for transmitting and/or receiving RF signals to communicate via a second MIMO channel on said second axis of polarization of said means for transmitting and/or receiving electromagnetic energy.

17. An apparatus as claimed in claim 11, said first means for transmitting and/or receiving RF signals and said second means for transmitting and/or receiving RF signals to provide beam steering via said first axis of polarization of said means for transmitting and/or receiving electromagnetic energy and said second axis of polarization of said means for transmitting and/or receiving electromagnetic energy.

18. An apparatus as claimed in claim 11, said first means for transmitting and/or receiving RF signals to communicate with a first remote device using a first communication standard via said first axis of polarization of said means for transmitting and/or receiving electromagnetic energy, and said second means for transmitting and/or receiving RF signals to communicate with a second remote device using a second communication standard via said second axis of polarization of said means for transmitting and/or receiving electromagnetic energy.

19. An apparatus, comprising:

a first antenna element comprising first and second radiating elements to provide a first axis of polarization;

a second antenna element comprising first and second radiating elements to provide a second axis of polarization; and a circuit board, said first antenna element being disposed on a first side of said circuit board and said second antenna element being disposed on a second side of said circuit board, and wherein the first axis of polarization is orthogonal at least in part to the second axis of polarization.

20. An apparatus as claimed in claim 19, further comprising an antenna housing, said circuit board, first antenna element and second antenna element being disposed within said housing.

21. An apparatus as claimed in claim 19, further comprising an antenna housing, said first antenna element and said second antenna element being disposed on said circuit board, said circuit board being disposed within said antenna housing.

22. An apparatus as claimed in claim 19, further comprising an antenna housing, said first antenna element being disposed on a first side of said circuit board and said second antenna element being disposed on a second side of said circuit board, said circuit board being disposed within said antenna housing.

23. An apparatus as claimed in claim 19, further comprising a first lead to couple to the first and second radiating elements of said first antenna element, and a second lead to couple to the first and second radiating elements of said second antenna.

24. An apparatus as claimed in claim 19, further comprising a first lead to couple to the first and second radiating elements of said first antenna element, and a second lead to couple to the first and second radiating elements of said second antenna, said first lead to couple said first antenna element to a first transceiver, and said second lead to couple said second antenna element to a second transceiver.

25. An apparatus as claimed in claim 19, further comprising a first lead to couple to the first and second radiating elements of said first antenna element, and a second lead to couple to the first and second radiating elements of said second antenna, said first and second leads to couple said first and second antennas to a MIMO transceiver.

26. An apparatus as claimed in claim 19, further comprising a first lead to couple to the first and second radiating elements of said first antenna element, and a second lead to couple to the first and second radiating elements of said second antenna, said first and second leads to couple said first and second antennas to a diversity transceiver.

27. An apparatus as claimed in claim 19, wherein the first radiating element and the second radiating element of at least one of said first antenna element or said second antenna element are coplanar.

28. An apparatus as claimed in claim 19, wherein the first radiating element and the second radiating element of said first antenna are coplanar on one side of said circuit board, and the first radiating element and the second radiating element of said second antenna are coplanar on one side of the circuit board.

* * * * *